US006833659B2

(12) United States Patent
Gaertner et al.

(10) Patent No.: US 6,833,659 B2
(45) Date of Patent: Dec. 21, 2004

(54) CATHODE RAY TUBE COMPRISING A CATHODE OF A COMPOSITE MATERIAL

(75) Inventors: Georg Friedrich Gaertner, Aachen (DE); Petrus Arthur Marie Van Der Heide, Clitheroe (GB); Wyndham Michael Johnstone, Leyland (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 224 days.

(21) Appl. No.: 09/954,656

(22) Filed: Sep. 18, 2001

(65) Prior Publication Data

US 2002/0074921 A1 Jun. 20, 2002

(30) Foreign Application Priority Data

Sep. 19, 2000 (EP) ..... 00308163

(51) Int. Cl.[7] ..... H01J 1/14; H01J 19/06

(52) U.S. Cl. ..... 313/346 R; 313/310; 313/311; 313/346 DC

(58) Field of Search ..... 313/310, 311, 313/346 R, 346 DC, 355, 341, 326, 337; 445/49, 50, 51

(56) References Cited

U.S. PATENT DOCUMENTS 4,797,593 A * 1/1989 Saito et al. ..... 313/346 R
5,075,589 A * 12/1991 Derks et al. ..... 313/346 DC
5,216,320 A * 6/1993 Koizumi et al. ..... 313/346 R
5,828,165 A * 10/1998 Clerc et al. ..... 313/346 DC
6,124,666 A * 9/2000 Saito et al. ..... 313/346 R
6,504,293 B1 * 1/2003 Koizumi et al. ..... 313/346 R

FOREIGN PATENT DOCUMENTS

EP 0395157 8/1991 ..... H01J/1/14
EP 641006 A1 * 3/1995 ..... H01J/1/14
JP 62165833 A * 7/1987 ..... H01J/1/14

* cited by examiner

*Primary Examiner*—Nimeshkumar D. Patel
*Assistant Examiner*—Mariceli Santiago

(57) ABSTRACT

A cathode ray tube provided with at least one oxide cathode comprising a cathode carrier with a cathode base of a cathode metal and a cathode coating of an electron-emitting material containing a particle-particle composite material of oxide particles of an alkaline earth oxide selected from the group formed by the oxides of calcium, strontium and barium, and oxide particles having a first grain size distribution of an oxide selected from the group formed by the oxides of scandium, yttrium and the lanthanoids, and oxide particles having a second grain size distribution of an oxide selected from the group formed by the oxides of scandium, yttrium and the lanthanoids. The invention also relates to an oxide cathode.

3 Claims, 1 Drawing Sheet

CATHODE RAY TUBE COMPRISING A CATHODE OF A COMPOSITE MATERIAL

Figure 1:
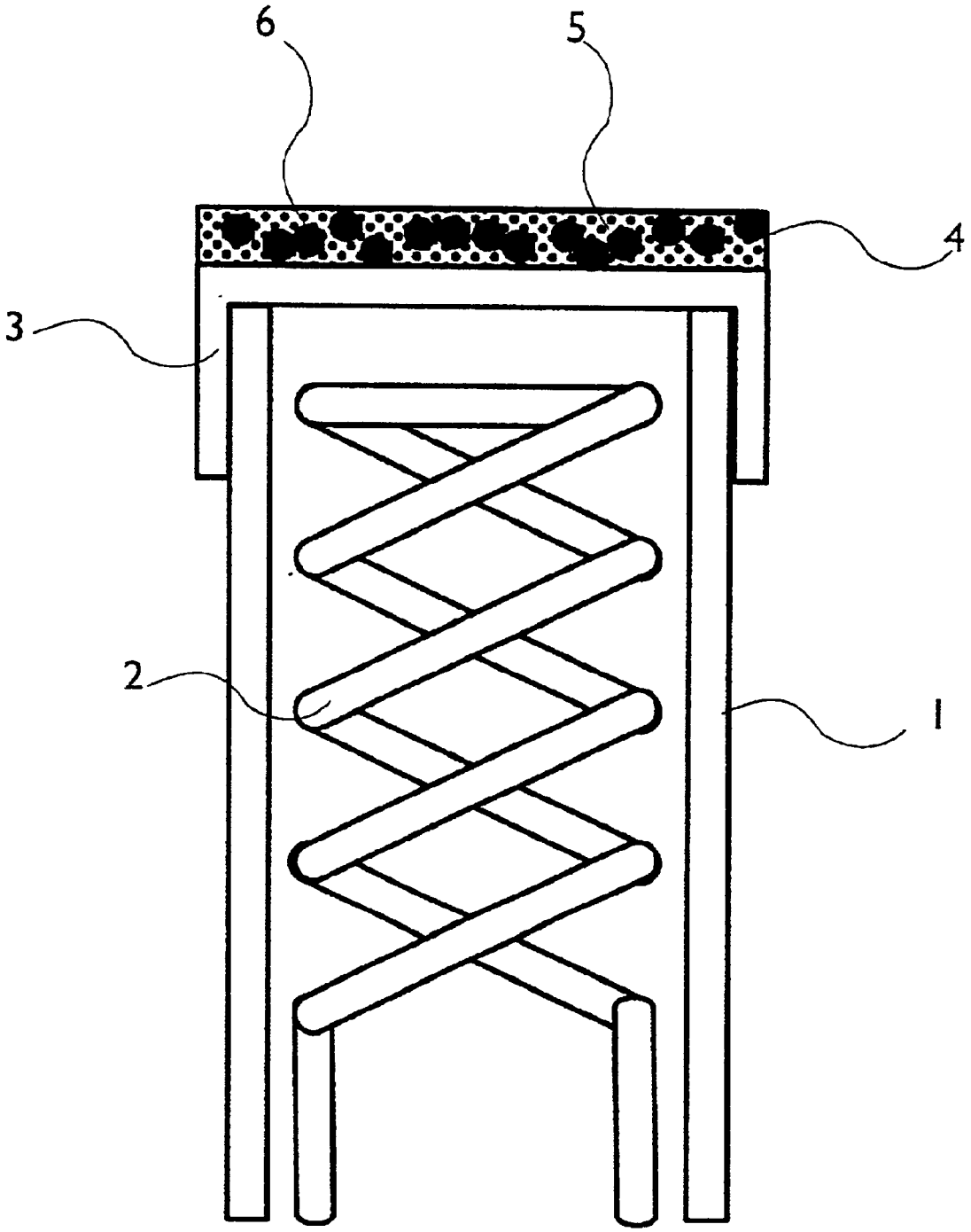

The invention relates to a cathode ray tube provided with at least one oxide cathode comprising a cathode carrier with a cathode base of a cathode metal and a cathode coating of an electron-emitting material containing barium, a further alkaline earth oxide and yttrium oxide, scandium oxide or a rare earth metal oxide in the form of oxide particles.

A cathode ray tube is composed of 4 functional groups:
electron beam generation in the electron gun,
beam focusing using electrical or magnetic lenses,
beam deflection to generate a raster, and
luminescent screen or display screen.

The functional group relating to electron beam generation comprises an electron-emitting cathode, which generates the electron current in the cathode ray tube and which is enclosed by a control grid, for example a Wehnelt cylinder having an apertured diaphragm on the front side.

An electron-emitting cathode for a cathode ray tube generally is a punctiform, heatable oxide cathode with an electron-emitting, oxide-containing cathode coating. If an oxide cathode is heated, then electrons are evaporated from the electron-emitting coating into the surrounding vacuum. If the Wehnelt cylinder is biased with respect to the cathode, then the quantity of emergent electrons and hence the beam current of the cathode ray tube can be controlled.

The quantity of electrons that can be emitted by the cathode coating depends on the work function of the electron-emitting material. Nickel, which is customarily used for the cathode base, has itself a comparatively high work function. For this reason, the metal of the cathode base is customarily coated with another material, which mainly serves to improve the electron-emitting properties of the cathode base. A characteristic feature of the electronemitting coating materials of oxide cathodes is that they comprise an alkaline earth metal in the form of the alkaline earth metal oxide.

To manufacture an oxide cathode, a suitably shaped nickel sheet is coated, for example, with the carbonates of the alkaline earth metals in a binder preparation. During evacuating and baking out the cathode ray tube, the carbonates are converted to the alkaline earth metal oxides at temperatures of approximately 1000° C. After this bum-off of the cathode, said cathode already supplies a noticeable emission current which, however, is still unstable. Next, an activation process is carried out. This activation process causes the originally non-conducting ionic lattice of the alkaline earth oxides to be converted to an electronic semiconductor in that donor-type impurities are incorporated in the crystal lattice of the oxides. These impurities essentially consist of elementary alkaline earth metal, for example calcium, strontium or barium. The electron emission of such oxide cathodes is based on the impurity mechanism. Said activation process serves to provide a sufficiently large quantity of excess, elementary alkaline earth metal, which enables the oxides in the electron-emitting coating to supply the maximum emission current at a prescribed heating capacity. A substantial contribution to the activation process is made by the reduction of barium oxide to elementary barium by alloy constituents ("activators") of the nickel from the cathode base.

For the function and the service life of an oxide cathode it is important that elementary alkaline earth metal is continuously dispensed. The reason for this being that the cathode coating continuously loses alkaline earth metal during the service life of the cathode. The cathode material partly evaporates slowly and is partly sputtered off by the ion current in the lamp.

However, initially the elementary alkaline earth metal is continuously dispensed. Said dispensation stops, however, when a thin, yet high-impedance interface of alkaline earth silicate or alkaline earth aluminate forms between the cathode base and the emitting oxide in the course of time.

The service life is also influenced by the fact that the amount of activator metal in the nickel alloy of the cathode base becomes depleted in the course of time.

U.S. Pat. No. 5,075,589 issued 24 Dec. 1991 to Dirks et al. discloses an oxide cathode comprising a carrier body, which is essentially composed of nickel, and a layer of an electron-emitting material containing alkaline earth oxide including barium and maximally 5% by weight yttrium oxide, scandium oxide or rare earth metal oxide, said yttrium oxide, scandium oxide and the rare earth metal oxide being particles, the majority of which have a diameter of maximally 5 $\mu$m.

It is an object of the invention to provide a cathode ray tube, the beam current of which is uniform and remains constant for a long period of time, while said cathode ray tube can be reproducibly manufactured.

In accordance with the invention, this object is achieved by a cathode ray tube provided with at least one oxide cathode comprising a cathode carrier with a cathode base of a cathode metal and a cathode coating of an electron-emitting material containing a particle-particle composite material of oxide particles of an alkaline earth oxide selected from the group formed by the oxides of calcium, strontium and barium, and oxide particles having a first grain size distribution of an oxide selected from the group formed by the oxides of scandium, yttrium and the lanthanoids, and oxide particles having a second grain size distribution of an oxide selected from the group formed by the oxides of scandium, yttrium and the lanthanoids.

Cathode ray tubes comprising such an oxide cathode have a uniform beam current for a long period of time, which can be attributed to the fact that the bimodal grain size distribution of the oxide particles of the oxides of scandium, yttrium and the lanthanoids in the electron-emitting material of the cathode coating causes the initial emission to be high already while the resistance to oxygen poisoning is low.

The bimodal grain size distribution also leads to an increase of the Ba retention. The cathode is not susceptible to ion bombardment, its emission is uniform and it can be reproducibly manufactured.

As barium is dispensed continuously, depletion of the electron emission, as known from the oxide cathodes according to the prior art, is precluded. Substantially higher beam current densities can be obtained without adversely affecting the service life. This can also be used to draw the necessary electron beam currents from smaller cathode regions. The spot size of the hot spot determines the beam focusing quality on the display screen. The picture definition is increased throughout the screen. As, in addition, the cathodes are not subject to aging, picture brightness and picture definition can be maintained at a high level throughout the service life of the tube.

Within the scope of the invention it is preferred that the oxide particles having a first grain size distribution have an average grain size $0.4<d_{50}<5$ $\mu$m, and the oxide particles having a second grain size distribution have an average grain size $d_{50}\leqq 0.4$ $\mu$m.

It may alternatively be preferred that the electron-emitting material comprises the oxide particles having a first grain size distribution in a concentration in the range from 0.1 to 20 wt. %, and the oxide particles having a second grain size distribution in a concentration in the range from $1*10^{-6}$ to $1*10^{-3}$ wt. %.

It may be additionally preferred that the oxide particles of an alkaline earth oxide selected from the group formed by the oxides of calcium, strontium and barium are doped with an element selected from the group formed by scandium, yttrium and the lanthanoids in a quantity ranging from $0.10*10^{-6}$ to $10*10^{-6}$ wt. %.

In another preferred embodiment of the invention, the electron-emitting material is a stratified composite of at least a first and at least a second layer, said first layer comprising oxide particles of an alkaline earth oxide selected from the group formed by the oxides of calcium, strontium and barium, and oxide particles having a first grain size distribution of an oxide selected from the group formed by the oxides of scandium, yttrium and the lanthanoids, and said second layer comprising oxide particles of an alkaline earth oxide selected from the group formed by the oxides of calcium, strontium and barium, and oxide particles having a second grain size distribution of an oxide selected from the group formed by the oxides of scandium, yttrium and the lanthanoids.

In a further preferred embodiment of the invention, the electron-emitting material is a stratified composite of at least a first and at least a second layer, said first layer comprising oxide particles of an alkaline earth oxide selected from the group formed by the oxides of calcium, strontium and barium, and oxide particles of an oxide selected from the group formed by the oxides of scandium, yttrium and the lanthanoids having a first or a second grain size distribution in a quantity ranging from 2 to 20 wt. %, and said second layer comprising oxide particles of an alkaline earth oxide selected from the group formed by the oxides of calcium, strontium and barium, and oxide particles of an oxide selected from the group formed by the oxides of scandium, yttrium and the lanthanoids having a first or a second grain size distribution in a quantity ranging from 0.1 to 5 wt. %.

If the electron-emitting material comprises 1 to 3 wt. % particles of an activator metal selected from the group formed by Mg, Al, Fe, Si, Ti, Hf, Zr, W, Mo, Mn and Cr, or the electron-emitting material comprises 1 to 3 wt. % particles of an activator metal selected from the group formed by Mg, Al, Fe, Si, Ti, Hf, Zr, W, Mo, Mn and Cr, which are coated with a metal selected from the group formed by Pd, Rh, Pt, Co, Ni, Ir, Re, the oxide cathode combines robust behavior with rapid switching.

The invention also relates to an oxide cathode comprising a cathode carrier with a cathode base of a cathode metal and a cathode coating of an electron-emitting material comprising a particle-particle composite material of oxide particles of an alkaline earth oxide selected from the group formed by the oxides of calcium, strontium and barium, and oxide particles having a first grain size distribution of an oxide selected from the group formed by the oxides of scandium, yttrium and the lanthanoids, and oxide particles having a second grain size distribution of an oxide selected from the group formed by the oxides of scandium, yttrium and the lanthanoids.

These and other aspects of the invention will be apparent from and elucidated with reference to two embodiments described hereinafter.

In the drawing:

FIG. 1 is a diagrammatic cross-sectional view of an embodiment of the cathode in accordance with the invention.

A cathode ray tube comprises an electron beam-generating system which customarily includes an arrangement with one or more oxide cathodes.

An oxide cathode in accordance with the invention comprises a cathode carrier with a cathode base and a cathode coating. The cathode carrier includes the heater and the base for the cathode body. For the cathode carrier use can be made of the constructions and materials known from the prior art.

In the embodiment of the invention shown in FIG. 1, the oxide cathode comprises a cathode carrier, i.e. a cylindrical tube 3 wherein the heating wire 4 is inserted, a top cap 2 forming the cathode base, and a cathode coating 1 which represents the actual cathode body.

Customarily, the material used for the cathode base is a nickel alloy. The nickel alloy used for the base of the oxide cathode in accordance with the invention may comprise, for example, nickel with an alloying constituent of an activator element having a reducing effect selected from the group formed by silicon, magnesium, aluminum, tungsten, molybdenum, manganese and carbon.

The electron-emitting material of the cathode coating contains oxide particles. The main components of the electron-emitting material are oxide particles of an alkaline earth oxide, preferably barium oxide, in conjunction with calcium oxide or/and strontium oxide. The alkaline earth oxides are used as a physical mixture of alkaline earth oxides or as binary or ternary mixed crystals of the alkaline earth metal oxides. Preferably, use is made of a ternary alkaline earth mixed crystal oxide of barium oxide, strontium oxide and calcium oxide or a binary mixture of barium oxide and calcium oxide.

The alkaline earth oxide may contain a doping of an oxide selected from the oxides of scandium, yttrium and the lanthanoids: lanthanum, cerium, praseodymium, neodymium, samarium, europium, gadolinium, terbium, dysprosium, holmium, erbium, thulium, ytterbium and lutetium, for example in a quantity from 10 to maximally 1000 ppm. The ions of scandium, yttrium and the lanthanoids occupy lattice sites or interstitial lattice sites in the crystal lattice of the alkaline earth metal oxides.

As the second component, the electron-emitting material comprises oxide particles of an oxide of scandium, yttrium and the lanthanoids in a first grain size distribution having an average grain size in the range from, preferably, $0.4<d_{50}<5$ $\mu$m.

As the third component, the electron-emitting material comprises oxide particles of an oxide of scandium, yttrium and the lanthanoids in a second grain size distribution, preferably, having an average grain size $d_{50}\leqq 0.4$ $\mu$m.

The electron-emitting material may comprise a particulate activator metal as the fourth component. Preferably, said electron-emitting material comprises 1 to 3 wt. % particles of an activator metal selected from the group formed by Mg, Al, Fe, Si, Ti, Hf, Zr, W, Mo, Mn and Cr, which are coated with a metal selected from the group formed by Pd, Rh, Pt, Co, Ni, Ir, Re.

The components of the electron-emitting material of the cathode coating are provided in accordance with a particle-particle-composite arrangement. Particularly advantageous effects in comparison with the prior art are obtained using an oxide cathode in accordance with the invention having a particle-particle composite, where the surface of the oxide particles of an alkaline earth oxide is covered with a layer of fine-grain oxide particles of the oxides of scandium, yttrium or the lanthanoids. In this oxide cathode, the Ba retention is particularly improved.

Apart from said particle-particle composite, the components of the electron-emitting material may also form a laminated composite. For example, the cathode base can be coated first with a first layer comprising oxide particles of an alkaline earth oxide selected from the group formed by the oxides of calcium, strontium and barium, and oxide particles having a first grain size distribution of an oxide selected from the group formed by the oxides of scandium, yttrium and the lanthanoids. To the first layer, a second layer is applied comprising oxide particles of an alkaline earth oxide selected from the group formed by the oxides of calcium, strontium and barium, and oxide particles having a second grain size distribution of an oxide selected from the group formed by the oxides of scandium, yttrium and the lanthanoids.

In the laminated composite, the first layer may also comprise oxide particles of an alkaline earth oxide selected from the group formed by the oxides of calcium, strontium and barium, and oxide particles of an oxide selected from the group formed by the oxides of scandium, yttrium and the lanthanoids having a first or a second grain size distribution in a quantity ranging from 2 to 20 wt. %, and the second layer may comprise oxide particles of an alkaline earth oxide selected from the group formed by the oxides of calcium, strontium and barium, and oxide particles of an oxide selected from the group formed by the oxides of scandium, yttrium and the lanthanoids having a first or a second grain size distribution in a quantity ranging from 0.1 to 5 wt. %.

To manufacture the raw mixture for the cathode coating, the carbonates of the alkaline earth metals calcium, strontium and barium are ground and mixed with each other and with a starting compound for the oxide of scandium, yttrium, lanthanum, cerium, praseodymium, neodymium, samarium, europium, gadolinium, terbium, dysprosium, holmium, erbium, thulium, ytterbium and lutetium in the desired weight ratio. For the starting compounds of the oxides of scandium, yttrium and the lanthanoids, use is preferably made of the nitrates or hydroxides of these elements.

The weight ratio of calcium carbonate: strontium carbonate: barium carbonate is typically 1:1.25:6 or 1:12:22 or 1:1.5:2.5 or 1:4:6.

In order to dope the oxides of the alkaline earth metals with the oxides of scandium, yttrium, lanthanum, cerium, praseodymium, neodymium, samarium, europium, gadolinium, terbium, dysprosium, holmium, erbium, thulium, ytterbium and lutetium, the carbonates of the alkaline earth metals can be co-precipitated with the nitrates of scandium, yttrium and the lanthanoids.

In addition, a metal powder selected from the metals of the group formed by aluminum, silicon, titanium, zirconium, hafnium, tantalum, molybdenum, tungsten and their alloys with a metal of the group formed by rhenium, rhodium, palladium, iridium and platinum is provided with a powder coating of a noble metal such as rhenium, nickel, cobalt, ruthenium, palladium, rhodium, iridium or platinum. Preferably, a metal powder having an average grain size from 2 to 3 $\mu$m with a 0.1 to 0.2 thick powder coating is used.

The raw mixture may additionally be mixed with a binder preparation. Said binder preparation may comprise water, ethanol, ethylnitrate, ethylacetate or diethylacetate as the solvent.

Said raw mixture is subsequently applied to the carrier by brushing, dip coating, cataphoretic deposition or spraying.

The cathode thus coated is placed in the cathode ray tube. The cathode is formed when the cathode ray tube is being evacuated. By heating to a temperature in the range from approximately 650 to 1100° C., the alkaline earth carbonates are converted to alkaline earth oxides thereby releasing CO and $CO_2$, after which said alkaline earth oxides form a porous sintered body. Another important factor in this conversion process is the crystallographic change caused by mixed crystal formation, which is a prerequisite for a good oxide cathode. After this cathode "bum-off", an activation process is carried out which serves to supply excess elementary alkaline earth metal which is included in the oxides. Said excess alkaline earth metal is formed by reduction of alkaline earth metal oxide. In the actual reduction activation process, the alkaline earth oxide is reduced by the released CO or activator metal from the cathode base. In addition, a current-activation process takes place, which is responsible for generating the required free alkaline earth metal by electrolytic processes at elevated temperatures.

EXAMPLE 1

As shown in FIG. 1, an oxide cathode for a cathode ray tube in accordance with a first embodiment of the invention comprises a cap-shaped cathode base composed of an alloy of nickel with 0.03 wt. % Mg, 0.02 wt. % Al and 1.0 wt. % W. The cathode base is situated at the upper end of a cylindrical cathode carrier (bushing) wherein the heater is mounted.

The cathode is provided with a cathode coating on the upper side of the cathode base. To form the cathode coating, the cathode base is cleaned first. Subsequently, a mixture of 3.0 wt. % scandium oxide powder and 97 wt. % powder of starting compounds for the oxides is suspended in a solution of ethanol, butylacetate and nitrocellulose. The scandium oxide powder has an elongated granular structure with an average grain size of 3±2 $\mu$m. The powder with the starting compounds for the oxides consists of co-precipitated barium-strontium-calcium-carbonate in a weight ratio of 22:12:1 and 150 ppm scandium oxide.

This suspension is sprayed onto the cathode base. The layer is formed at a temperature in the range from 650 to 1100° C. in order to bring about alloying and diffusion between the cathode metal of the cathode base and the oxide particles.

The cathode thus formed has a low work function of 1.44 eV, a conductance which is improved by a factor of 2, and an extended service life as compared to a conventional triple oxide emitter.

EXAMPLE 2

As shown in FIG. 1, a cathode for a cathode ray tube in accordance with a second embodiment of the invention comprises a cap-shaped cathode base composed of an alloy of nickel with 0.1 wt. % Mg, 0.06 wt. % Al and 2.0 wt. % W. The cathode base is situated at the upper end of a cylindrical cathode carrier (bushing) wherein the heater is mounted. The cathode is provided with a cathode coating on the upper side of the cathode base.

To form the cathode coating, the cathode base is cleaned first. Subsequently, a mixture of 1.50 wt. % yttrium oxide powder and 98.5 wt. % powder of starting compounds for the oxides is suspended in a solution of ethanol, butylacetate and nitrocellulose. The yttrium oxide powder has an elongated granular structure with an average grain size of 2 $\mu$m. The powder with the starting compounds for the oxide consists of co-precipitated barium-strontium-carbonate in a weight ratio of 1:1 and 100 ppm yttrium oxide.

This suspension is sprayed onto the cathode base. The layer thickness is 70 $\mu$m. The layer is formed at a temperature in the range from 650 to 1100° C. in order to bring about alloying and diffusion between the cathode metal of the cathode base and the oxide particles.

The cathode thus formed has a low work function of 1.4 eV, a conductance which is improved by a factor of 1.5, an extended service life and a higher resistance to poisoning as compared to a conventional triple oxide emitter.

EXAMPLE 3

As shown in FIG. 1, a cathode for a cathode ray tube in accordance with a third embodiment of the invention comprises a cap-shaped cathode base composed of an alloy of nickel with 0.05 wt. % Mg, 0.05 wt. % Al and 2.0 wt. % W. The cathode base is situated at the upper end of a cylindrical cathode carrier (bushing) wherein the heater is mounted. The cathode is provided with a cathode coating on the upper side of the cathode base.

To form the cathode coating, the cathode base is cleaned first. Subsequently, a mixture of 1.2 wt. % scandium oxide powder and 98.8 wt. % powder of starting compounds for the oxides is suspended in a solution of ethanol, butylacetate and nitrocellulose. The scandium oxide powder has an elongated granular structure with an average grain size of 1.7 $\mu$m. The powder with the starting compounds for the alkaline earth oxides consists of co-precipitated barium-strontium-calcium-carbonate in a weight ratio of 1:1 and 120 ppm yttrium oxide with a grain size $d_{50}$<0.4 $\mu$m.

This suspension is sprayed onto the cathode base. The layer thickness is 70 $\mu$m. The layer is formed at a temperature in the range from 650 to 1100° C. in order to bring about alloying and diffusion between the cathode metal of the metal base and the oxide particles.

The cathode thus formed has a low work function of 1.42 eV, a conductance which is improved by a factor of 2, an extended service life and a higher resistance to poisoning as compared to a pure triple oxide emitter.

EXAMPLE 4

As shown in FIG. 1, a cathode for a cathode ray tube in accordance with a third embodiment of the invention comprises a cap-shaped cathode base composed of an alloy of nickel with 0.1 wt. % Mg, 0.06 wt. % Al and 2.0 wt. % W. The cathode base is situated at the upper end of a cylindrical cathode carrier (bushing) wherein the heater is mounted. The cathode is provided with a cathode coating on the upper side of the cathode base.

To form the cathode coating, the cathode base is cleaned first. Subsequently, a mixture of 2.1 wt. % europium oxide powder and 97.9 wt. % powder of starting compounds for the oxides is suspended in a solution of ethanol, butylacetate and nitrocellulose. The europium oxide powder has an elongated granular structure with an average grain size of 2.7 $\mu$m. The powder with the starting compounds for the alkaline earth metal oxides consists of co-precipitated barium-strontium-calcium-carbonate in a weight ratio of 6:4:1 and 0.02 wt. % europium oxide with a grain size $d_{50}$<0.4 $\mu$m.

This suspension is sprayed onto the cathode base. The layer is formed at a temperature in the range from 650 to 1100° C. in order to bring about alloying and diffusion between the cathode metal of the metal base and the oxides.

The cathode thus formed has a low work function of 1.4 eV, a conductance which is improved by a factor of 1.5, an extended service life and a higher resistance to poisoning as compared to a conventional triple oxide emitter.

What is claimed is:

1. A cathode ray tube provided with at least one oxide cathode comprising a cathode carrier with
- a cathode base of a cathode metal and
- a cathode coating of an electron-emitting material containing a particle-particle composite material of
  - oxide particles of an alkaline earth oxide selected from the group formed by the oxides of calcium, strontium and barium, and
  - oxide particles having a first grain size distribution of an oxide selected from the group formed by the oxides of scandium, yttrium and the lanthanoids, and
  - oxide particles having a second grain size distribution of an oxide selected from the group formed by the oxides of scandium, yttrium and the lanthanoids, characterized in that the electron-emitting material is a stratified composite of at least a first and at least a second layer, said first layer comprising the oxide particles of the alkaline earth oxide selected from the group formed by the oxides of calcium, strontium and barium, and the oxide particles having the first grain size distribution of the oxide selected from the group formed by the oxides of scandium, yttrium and the lanthanoids, and said second layer comprising the oxide particles of the alkaline earth oxide selected from the group formed by the oxides of calcium, strontium and barium, and the oxide particles having the second grain size distribution of the oxide selected from the group formed by the oxides of scandium, yttrium and the lanthenoids.

2. A cathode ray tube as claimed in claim 1, characterized in that the first grain size distribution is in a quantity ranging from 2 to 20 wt. %, and having the second grain size distribution is in a quantity ranging from 0.1 to 5 wt. %.

3. A cathode ray tube provided with at least one oxide cathode comprising a cathode carrier with
- a cathode base of a cathode metal and
- a cathode coating of an electron-emitting material containing a particle-particle composite material of
  - oxide particles of an alkaline earth oxide selected from the group formed by the oxides of calcium, strontium and barium, and
  - oxide particles having a first grain size distribution of an oxide selected from the group formed by the oxides of scandium, yttrium and the lanthanoids, and
  - oxide particles having a second grain size distribution of an oxide selected from the group formed by the oxides of scandium, yttrium and the lanthanoids, characterized in that the electron-emitting material comprises 1 to 3 wt. % particles of an activator metal selected from the group formed by Mg, Al, Fe, Si, Ti, Hf, Zr, W, Mo, Mn and Cr, which are coated with a metal selected from the group formed by Pd, Rh, Pt, Co, Ni, Ir, and Re.

* * * * *